US006326616B1

(12) United States Patent
Andrien, Jr. et al.

(10) Patent No.: US 6,326,616 B1
(45) Date of Patent: Dec. 4, 2001

(54) CURVED INTRODUCTION FOR MASS SPECTROMETRY

(75) Inventors: Bruce A. Andrien, Jr., Branford; Michael A. Sansone, Hamden; Allan G. Burt, East Haven; Craig M. Whitehouse, Branford, all of CT (US)

(73) Assignee: Analytica of Branford, Inc., Branford, CT (US)

( * ) Notice: Subject to any disclaimer, the term of this patent is extended or adjusted under 35 U.S.C. 154(b) by 0 days.

(21) Appl. No.: 09/173,195

(22) Filed: Oct. 15, 1998

Related U.S. Application Data

(60) Provisional application No. 60/062,117, filed on Oct. 15, 1997.

(51) Int. Cl.[7] ..... H01J 49/10
(52) U.S. Cl. ..... 250/288
(58) Field of Search ..... 250/288, 281, 250/282, 423 R

(56) References Cited

U.S. PATENT DOCUMENTS

| | | | | |
|---|---|---|---|---|
| 5,103,093 | * | 4/1992 | Sakairi et al. | 250/288 |
| 5,756,994 | * | 5/1998 | Bajic | 250/288 |
| 5,844,237 | * | 12/1998 | Whitehouse et al. | 250/288 |
| 6,121,608 | * | 9/2000 | Takada et al. | 250/288 |

* cited by examiner

*Primary Examiner*—Kiet T. Nguyen
(74) *Attorney, Agent, or Firm*—Levisohn, Lerner, Berger & Langsam

(57) ABSTRACT

A single or multiple layer curved Electrospray sample introduction means has been configured in an Atmospheric Pressure Ion (API) source interfaced to a mass analyzer. Sample solutions introduced through curved or bent sample introduction Electrospray (ES) probes configured in an API source are sprayed from the ES probe tip at an angle which differs from centerline of the ES probe body. Single or multiple curved ES probes can be configured in an Atmospheric Pressure Ion source interfaced to mass analyzers. Curved ES probes can also be configured in an API source which includes Atmospheric Pressure Chemical ionization.

59 Claims, 8 Drawing Sheets

SECTION A-A

CURVED INTRODUCTION FOR MASS SPECTROMETRY

RELATED APPLICATIONS

The present application claims all rights of priority to U.S. Provisional Application Serial No. 60/062,117 filed Oct. 15, 1997, the contents of which is fully incorporated herein by reference.

BACKGROUND OF THE INVENTION

Atmospheric Pressure Ion (API) Sources configured with Electrospray (ES) ionization interfaced to mass analyzers include at least one Electrospray sample introduction probe. Commercially available ES probes can be roughly categorized into two types, flow-through and non flow-through configurations. The non flow-through ES probes are usually configured as pre-loaded microtips where no additional sample solution is added during the spraying process. Flow-through ES probes allow the delivery of a continuous solution flow to the ES probe tip from a fluid delivery system located outside the ES chamber. ES flow-through tips have been constructed with one or more straight tube layers to simultaneously deliver liquid and gas from the attached transfer lines to the ES probe tip during operation. Flow-through ES probes are typically configured with flexible solution and gas transfer lines connected to a probe body. The liquid and gas transfer lines may be attached to the ES probes at various angles, but the single or layered tubes within ES probes have been configured as straight tubes from the point of delivery line attachment to the ES probe tip. Even in ES probes configured with a single tube for liquid sample delivery, the single tube within the ES probe body is straight after the liquid transfer line attachment point to the ES probe body. When a single layer ES probe configuration is used, the sample bearing liquid is Electrosprayed directly from the exit tip of the probe tube. When it is desirable to operate Electrospray with pneumatic nebulization assist, a second layer tube is positioned surrounding and concentric to the innermost solution introduction tube, through which nebulization gas is delivered to the ES probe tip. Three concentric tube layers have been configured in ES probes to deliver a second liquid flow layered over the sample solution with a third layer for introduction of nebulizing gas at the ES probe tip.

Electrospray probes with straight single or layered tube configurations have been positioned on or off axis in Electrospray ion sources. Electrospray probes have been mounted with the probe tip axis aligned with the ES source axis as defined by the axis of the orifice into vacuum. ES probe assemblies have been configured in a fixed on-axis position or with the ability to have the probe tip position rotated and translated in the x, y and z direction around the ES source centerline. Off-axis ES probe assemblies have also been configured where the probe straight tube axis is generally positioned to direct the Electrosprayed solution toward the ES source centerline near the centerline of the orifice into vacuum. Off axis ES probes which incorporate pneumatic nebulization assist have also been used for higher liquid flow rate applications, as is described in U.S. Pat. No. 5,495,108. An off-axis Electrospray probe configured with pneumatic nebulization assist is generally mounted at an angle ranging from $\phi=40°$ to $\phi=90°$ relative to the ES source vacuum orifice centerline. U.S. Pat. No. 5,495,108 even describes that an ES probe with pneumatic nebulization assist can be mounted in a position $\phi=180°$ relative to the direction of gas flow through the vacuum orifice leading to the mass spectrometer. Analytica of Branford, Inc. has also configured ES sources with single or multiple ES probes mounted in a single source (see, Analytica's PCT patent application entitled Multiple Sample Introduction Mass Spectrometry and filed Sep. 11, 1998). In all cases, each ES probe assembly individually was configured with a straight and concentric single or layered tube assembly after the transfer line attachment points.

The straight ES probe assembly configuration requires that the entire ES probe body be angled and positioned to achieve the optimal ES probe tip position in an ES source chamber. This configuration of straight tube ES probes imposes constraints on the ES source chamber design, particularly for "off-axis" ES probe tip orientation. When off-axis ES probe mounting is used, the ES source chamber must be configured large enough to fit the ES probe body and transfer line attachments within the ES source chamber. Alternatively, the ES probe length must be increased or the ES chamber size reduced if it is desirable to position the off-axis ES probe body outside the ES source chamber with the probe assembly extending through the side wall of the ES chamber. When ES source configurations require applying kilovolt potentials to ES probes during operation, appropriate electrical insulation must be applied to any ES probes extending through the ES chamber walls. In some ES source configurations, ES probes are operated at ground potential, and kilovolt potentials are applied to surrounding electrodes. ES probes which extend through these electrodes can pass close to these electrodes and must be appropriately insulated. The surrounding electrode shapes and ES probes must be configured to accommodate "on-axis" and "off-axis" ES probe position placement while producing the desired electric fields during operation, even over a wide range of liquid flow rates.

An ES source can accommodate a sample liquid flow rate range of over 10,000 to 1. Depending on the analytical application, sample liquid can be sprayed at flow rates ranging from less than 25 nanoliters per minute to over 2.5 milliliters per minute. To achieve optimal performance over this range of liquid flow rates, ES sources can be configured to accommodate a number of ES probe configurations and a range of ES probe positions. For lower liquid flow rate applications, ES probes are generally positioned on or near the ES source centerline. With higher flow rate applications, ES probes may be positioned off the ES source centerline angled toward the centerline to optimize ES performance. To achieved added flexibility in operation, more than one ES probe can be mounted in the ES source simultaneously and even operated simultaneously. The size, complexity and cost of an ES source increases when it must accommodate the mounting of one or more ES probes in multiple positions when the ES probes are configured with straight single or multiple liquid and gas tubes after the transfer line attachment point. Particularly in low liquid flow rate applications where it is important to minimize dead volume, the liquid transfer lines are typically mounted "in-line" with the ES probe liquid sample delivery tube. The "in-line" connection of the sample delivery tube with the ES probe tube assembly may increase the ES probe length placing additional size and position constraints on the ES source and probe design.

SUMMARY OF THE INVENTION

In accordance with the present invention, the reconfiguration of ES probe delivery tubes is provided in a curved manner which relieves several of the design and operational constraints imposed by straight ES probe configurations. The curved or bent ES probe configuration increases the versatility of ES probe placement and operation and allows cost effective ES source design with little compromise in performance.

The present invention incorporates a curved tube configuration into ES probe assemblies. The curved tube ES probe configuration enables independent positioning of the ES probe tip and the probe body within an ES source chamber. This curved shape incorporated into ES probe assemblies allows single and multiple ES probe mounting positions to be achieved with simpler and lower cost ES source assemblies. In one embodiment of the invention described, a curved or bent ES probe is mounted to the back plate of an API source. This probe configuration includes concentric tubes that are bent in a double curve shape where the ES probe body is positioned with its axis along the ES source chamber centerline, and the ES probe tip is positioned off-axis and angled toward the ES source chamber centerline. Independent of the ES probe body orientation, the ES probe curve can be shaped such that the probe tip is positioned off axis pointing at an angle toward the centerline defined by the centerline of the ES source orifice into vacuum. The position of this ES probe tip, which may include layered liquid flow and/or pneumatic nebulization assist, can be adjusted in axial and angular directions relative to the vacuum orifice location to optimize ES source performance for a given application. The curved ES probe assembly can be configured to allow adjustment of the ES probe tip position during ES source operation. The ES probe position can be adjusted to fall on the vacuum orifice centerline or to a position well off the centerline. The curved probe configuration can accommodate any desired angle of spray relative to the vacuum orifice centerline. In addition, the invention enables the placement and simultaneous operation of multiple curved ES probes or combinations of straight and curved ES probes mounted in a single ES source. Different sample solutions can be introduced into the ES source chamber simultaneously through multiple ES probes during operation. To reduce cost and complexity of the ES source, all curved or combinations of curved and straight ES probes can be conveniently mounted to or through the back plate of the ES source chamber. Alternatively, combinations of back and side mounted probes can be configured in an ES source, if desired.

In one embodiment of the invention, an Electrospray ion source is configured with an Electrospray probe which includes a bent or curved portion in its fluid and gas delivery tubes. The ES probe body is mounted with its axis substantially aligned with the Electrospray source centerline and is configured with a three layer ES probe tip positioned off-axis to spray at an angle toward the ES source centerline as defined by the vacuum orifice centerline. The ES probe body includes means to adjust the probe tip position in the ES source chamber. The three layer bent or curved probe comprises liquid and gas delivery tubes that are configured with a double bend. This double bend allows the sample solution to enter the delivery tube flowing in a direction substantially aligned with the ES source centerline. The solution is sprayed toward the ES source centerline from the exit end of the delivery tube which is also the ES probe tip which is positioned off-axis. The axis of the ES tip and ES probe body axis are not aligned in the double bend ES probe configuration, allowing maximum flexibility in configuring ES source and ES probe geometries. The ES probe with a double bend delivery tube section can be configured with a single or multiple layered ES tip. Two and three layer ES curved ES probe tips can be operated with layered liquid flow or pneumatic nebulization assist. Curved ES probes may also be configured with ultrasonic nebulization assist. Each tube bore or annulus layer of a multiple tube curved ES probe may be connected to different gas or liquid delivery systems. In this manner, different samples, mixtures of samples and/or solvents can be sprayed simultaneously or individually in a variety of combinations at similar or different liquid flow rates. A calibration solution may be introduced through a tube layer and sprayed simultaneously with the sample solution to generate internal standard peaks in an ES spectrum. The liquid delivery systems include but are not limited to liquid chromatography pumps, syringe pumps, gravity feed vessels, pressurized vessels, and or aspiration feed vessels. Samples may also be introduced using auto injectors or "on-line" separation systems such as liquid chromatography (LC) or capillary electrophoresis (CE), capillary electrophoresis chromatography (CEC) and/or manual injection valves. ES sources configured with curved or bent inlet ES probes can be interfaced to any MS or $MS/MS^n$ mass analyzer type including but not limited to, Time-Of-Flight (TOF), Quadrupole, Fourier Transform (FTMS), Ion Trap, Magnetic Sector or a Hybrid mass analyzers.

In another embodiment of the invention, a single or multiple layered tube ES probe is configured with a single bend portion in its fluid and gas delivery tubes. The axis of the ES probe tip is not aligned with the ES probe body axis when a single bend is configured in the ES probe delivery tubes. The curved ES probe exit tip assemblies comprising multiple tube layers can be configured with means to ensure that the relative layered tube concentricity at the ES tip is retained around a common ES probe tip centerline. When compared to asymmetric tube layering, concentric positioning of tubes configured at the ES probe tip can improve the Electrospray plume uniformity around the ES probe tip centerline. This results in improved consistency of performance in Electrospray operation with layered liquid flow and/or pneumatic nebulization assist. An Electrospray ion source can also be configured with multiple ES probes comprising at least one curved Electrospray probe. An ES probe configured with one or more bends can be mounted in an ES source chamber with the ES probe body axis positioned substantially along the ES source centerline as described above. Alternatively ES probe bodies can be mounted off-axis with fixed or adjustable tip locations. One or more curved ES probes can also be configured in an Atmospheric Pressure Chemical Ionization Source (APCI) source providing the means to produce ions by Electrospray or Atmospheric Pressure Chemical Ionization either simultaneously or independently in the same API source without the need to switch probe hardware. U.S. Patent Application (Analytica's multiple probe patent application pending), describes the configuration of multiple sample introduction probes mounted in an ES or an Atmospheric Pressure Chemical Ionization (APCI) source, however, no curved ES probe configurations were included in the embodiments described.

The curved ES probe geometry allows greater flexibility and decreased complexity when configuring single or multiple sample introduction probes in an API source. Each curved ES probe in a set may be configured for operation with pneumatic or ultrasonic nebulization assist and multiple liquid and/or gas layering. Each liquid layer of each curved ES probe may be connected or switched to the same or different liquid delivery systems. Multiple ES probes configured in an API source allow the spraying of different liquid flow rates, and even completely different solutions delivered either simultaneously or sequentially into an API source without exchanging or even moving probe assemblies. Different ES MS analyses can be efficiently performed in a manual or unattended automated manner with little or no down time with multiple probe API source configurations. Individual sample mixtures which span different m/z ranges or sample types can be introduced through different ES probes to avoid cross contamination from one analysis to another. Depending on the unknown sample being analyzed, an optimal calibration solution can be chosen from another ES probe. For example, one m/z range calibration solution can be chosen which produces singly charged ES ions when analyzing singly charged compounds. Likewise, multiply charged ES generated calibration ions can be produced when analyzing compounds which form multiply charged ions in Electrospray ionization. The solution flow rate through a first ES probe can be controlled independent of the solution flow rate delivered through a second ES probe without having to reposition any probe tip location, change API source voltages or shut off gas or liquid flow to the second ES probe. Curved ES probe configurations allow tight clustering of ES probe tips if desired while leaving ES probe inlet ends conveniently spaced to facilitate connections of transfer lines and adjustment of probe tip positions. The multiply layered tube curved ES probe design allows for adjustment of relative tube exit end axial positions at the probe tip even during operation. In particular, the relative position of layered tube exit ends at the ES probe tip can be adjusted in a curved ES probe when the ES tip axis differs from the ES probe body axis. Due to this feature, multiple curved ES probes can be conveniently mounted through the back plate of an API source retaining full ES tip location and layered tube exit axial position adjustment even during ES operation. This capability facilitates setup and optimization time when conducting layered liquid flow CE, CEC or capillary column LC-MS analysis where the CE, CEC and/or LC columns are configured as the inner layer of a curved multiple layer ES probe.

DESCRIPTION OF THE INVENTION

Figure 1:
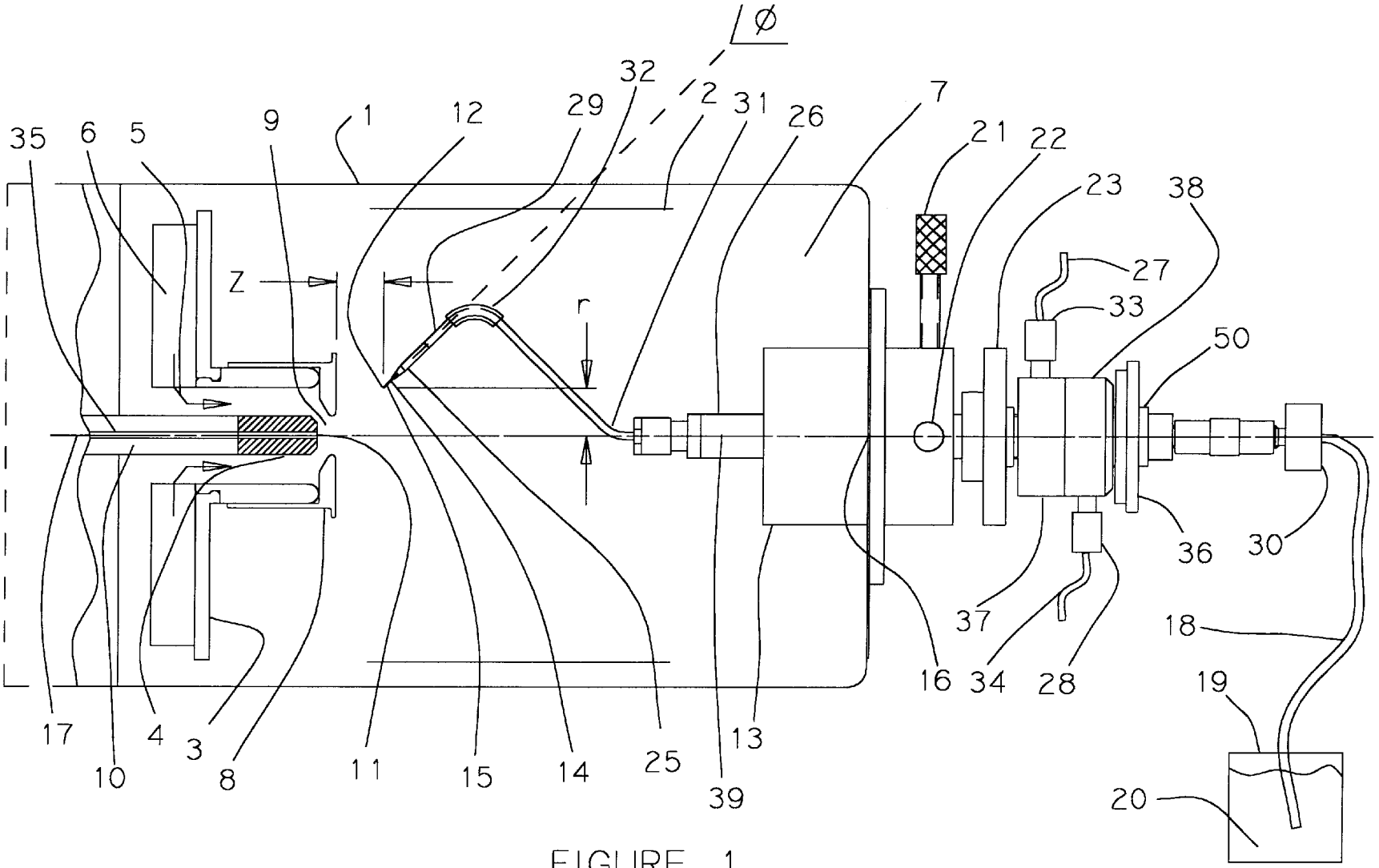
FIG. 1 is a plan view of an Electrospray ion source configured with a double bend Electrospray curved sample introduction probe assembly which includes tip position and layered tube axial position adjustment.

One embodiment of the invention, as diagrammed in FIG. 1, comprises an Electrospray ion source 1 which includes a three layer Electrospray sample introduction probe configured with double bend delivery tube or curved probe assembly 29. Electrospray probe assembly 13 can be configured with different layered tube bores to accommodate a flow rate ranging from below 25 nL/min to above 2 mL/min. Charged liquid droplets are formed from sample bearing solution by Electrospraying, or Electrospraying with pneumatic nebulization assist, the sample solution from ES probe tip 12. During Electrospray operation, electrical potentials are applied to cylindrical electrode 2, endplate electrode 3, capillary entrance electrode 4 and ES probe tip 12 while introducing sample solution through transfer line 18. Bath gas 5 is directed to flow through endplate heater 6 and into ES source chamber 7 through endplate nosepiece 8 opening 9. The orifice into vacuum as shown in FIG. 1 is a dielectric capillary tube 10 with bore 35 and entrance orifice 11. Bath gas 5 is delivered to ES chamber 7 substantially counter current to the direction of gas flow towards vacuum in capillary bore 35. This counter current bath gas flow aids in drying the Electrosprayed charged droplets and prevents unwanted neutral contamination from entering vacuum. Ions are produced from the evaporating charged liquid droplets as they traverse ES chamber 7. Ions can also be produced from evaporating charged droplets as they traverse bore 35 of capillary 10 on their way to vacuum. Heating capillary 10 can aid this droplet evaporation and ion production process. Ions and charged droplets are driven towards capillary entrance 11 by the electric fields established from the voltages applied to ES probe tip 12, cylindrical lens 2, endplate 3 with attached nosepiece 8 and capillary entrance electrode 4. A portion of the ions or charged droplets near capillary entrance 11 are swept into vacuum carried along by the neutral bath gas expanding into vacuum. A portion of the ions entering vacuum are directed into a mass analyzer with detector where they are mass analyzed.

The potential of an ion relative to ground potential can change as it is being swept through dielectric capillary tube 10 into vacuum as is described in U.S. Pat. No. 4,542,293. Due to this ability to change the ion potential energy by operating with a dielectric capillary, ES probe tip 12 can be maintained at ground potential during ES operation. Alternatively, if a nozzle, a thin plate orifice or an electrically conductive capillary is configured as an orifice into vacuum, ES probe tip 12 is maintained at high potential during ES operation. Configuring an ES source with a dielectric capillary does not preclude operating ES probe tip 12 at high potential; however, it is more convenient to operate ES probe 13 assembly with probe tip 12 at ground potential. This is the case particularly when the ES probe is connected to grounded LC separation systems or even injector valves with short liquid transfer line lengths to minimize dead volume. Any electrophoretic or electrolysis effects in the sample solution transfer lines and connectors are minimized when ES probe 13 and probe tip 12 are operated at ground potential. To produce positive ions with ES probe tip 12 maintained at ground potential, negative kilovolt potentials are applied to cylindrical electrode 2, endplate electrode 3 with attached electrode nosepiece 8 and capillary entrance electrode 4. Negative ions are produced by reversing the polarity of electrodes 2, 3, and 4 while ES probe tip 12 remains at ground potential. When a nozzle or a conductive (metal) capillary is used as the orifice into vacuum, kilovolt potentials are applied to ES curved probe assembly 29 with lower potentials applied to cylindrical electrode 2, endplate electrode 3 and the orifice into vacuum during operation. Heated capillaries can be configured as the orifice into vacuum, operated with or without counter-current bath gas.

In the embodiment of the invention diagrammed in FIG. 1, pivot point 16 of the body and entrance end 26 of ES curved probe assembly 13 is positioned parallel to the centerline or ES source chamber axis 17 of ES source 1. The angle of axis 39 of entrance end 26 of delivery tube assembly 29 relative to ES source centerline 17, as diagrammed, is equal to zero degrees. This aligns delivery tube entrance end axis 39 with ES source chamber axis 17 (radial distance R=0). Sample bearing solution can be introduced into solution transfer tube 18 of ES probe 13 with a liquid delivery system. Liquid delivery systems may include but are not limited to, liquid pumps with or without auto injectors, separation systems such as liquid chromatography or capillary electrophoresis, syringe pumps, pressure vessels, gravity feed vessels or solution reservoirs. During ES source operation, the spray produced from ES curved probe 13 can be initiated by turning on the liquid flow using a solution delivery system. Alternatively, where a pressure vessel or reservoir is used as a solution source, the liquid flow to ES curved probe tip 12 can be controlled by turning the nebulization gas flow on or off. When the nebulization gas flow is turned on, the venturi effect at the ES probe tip pulls solution from the reservoir to the ES probe tip where it is nebulized. As an example, an inexpensive solvent delivery system is shown in FIG. 1 comprising reservoir 19 containing a sample solution 20.

ES curved probe 13 solution transfer tube 18 is connected to solvent reservoir 19. With little or no pressure head or gravity feed applied, solution 20 can be pulled from reservoir 19 using the venturi suction effect of the nebulizing gas applied at ES probe tip 12. Transfer tube 18 can be initially filled with solution by applying head pressure to reservoir 19, by gravity feed of liquid through transfer tube 18 or by applying nebulizing gas which exits at ES probe tip 12. Once transfer tube 18 and the sample tube 15 of ES probe 13 is filled, any head pressure in the attached reservoir can be relieved and the liquid flow through sample tube 15 of probe 13 can be started and stopped by turning the nebulizing gas flow at tip 12 on and off. In the case where more precise control of the sample liquid flow rate is desired, a positive displacement liquid pump delivery system including but not limited to a syringe pump or a liquid chromatography system can be employed. Solution flow to tip 12 can then be turned on or off by turning the solvent delivery system flow on or off.

The x-y-z and angular positions of ES curved probe tip 12 as configured in FIG. 1 may be adjusted by turning positioning knobs 21, 22 and 23 to optimize ES performance while spraying. ES probe tip 12 positions may require adjustment to optimize ES performance for a given liquid flow rate and solution or sample type. Once optimized, probe tip 12 position can remain fixed during ES operation. As diagrammed in FIG. 1, the liquid and gas inlets or fittings 33, 28 and 30 of ES probe assembly 13, are located outside the ES source chamber housing for convenient connection of liquid or gas transfer lines 18, 27 and 34. The two axis rotation of ES probe tip 12 can be adjusted by turning adjustment knobs 21 and 22 and the Z position of ES probe tip 12 can be adjusted by turning knob 23. Turning knobs 21 and 22 rotates ES tip 12 and three layer delivery tube assembly 29 around pivot point 16 located inside ES probe assembly 13. Position adjustment knobs 21 and 22 rotate ES probe tip 12 and delivery tube assembly 29 in the y and x directions, respectively. Adjustment knob 23 shares centerline 39 moves with delivery tub assembly 29. Turning adjustment knob 23 moves ES tip 12 along the delivery tube assembly entrance axis 39. FIG. 1 shows the delivery tube entrance axis 39 aligned with ES source axis 17. In this position, adjustment of knob 23 changes the distance Z between ES probe tip 12 and the face of nosepiece 8. The delivery tube assembly, delivery tube entrance section 26, adjustment knobs 23 and 36, ES probe body sections 37 and 36 and inlet or fitting 30 all rotate around pivot point 16 when rotation position adjusters 21 and 22 are turned. The ES probe tip 12 position within ES source chamber 7 can be adjusted with knobs 21, 22 and 23 during Electrospray operation. Locating all ES probe tip position adjusters outside the ES chamber 7 allows efficient optimization of the ES probe tip after reconfiguring ES source 1 for a given application. The curved ES probe configuration allows configuration of an ES source having a wide range of ES tip positions with a constrained ES probe body location. Adjustment of curved probe ES tip positions can be made from outside the ES source chamber during operation independent of the ES tip angle or position in ES chamber 7.

As diagrammed in FIG. 1, axis 39 of ES probe delivery tube entrance assembly 26 and pivot point 16 are positioned along ES source centerline 17. The centerline of ES probe body 13 is located along the ES source centerline, that is at a radial distance R=0. ES probe tip 12 is positioned at an angle of $\phi$=45 degrees relative to ES source 1 and capillary 10 centerline 17. Tip 12 of ES probe is shown located at an axial distance Z from endplate nosepiece 8, a distance r radially from ES source centerline 17, and a radial angle $\theta$=0 degrees. $\theta$ (not shown) is defined as the radial angle around centerline 17 (perpendicular to the plane of the figure), in the direction that the gas flows through the capillary. With this orientation, the 12 o'clock location is defined as 0 degrees and the angle $\theta$ increases clockwise to 360 degrees. Spray tip 12 position may be aimed at the center of the endplate nosepiece opening 9 for lower liquid flow rates, i.e. Z=2 cm, and r=2 cm. For higher liquid flow rates, more optimal performance can be achieved by pointing the spray produced from angled tip 12 past nosepiece opening 9 but still passing through the center line of the of the ES source 17, i.e. Z=2 cm, and r=1 cm. The ES probe tip 12 angle, $\phi$, relative to ES source centerline 17 can be changed or the entire ES probe body with delivery tube assembly 26 can be moved radially off ES source centerline 17 where R≠0.

Figure 6:
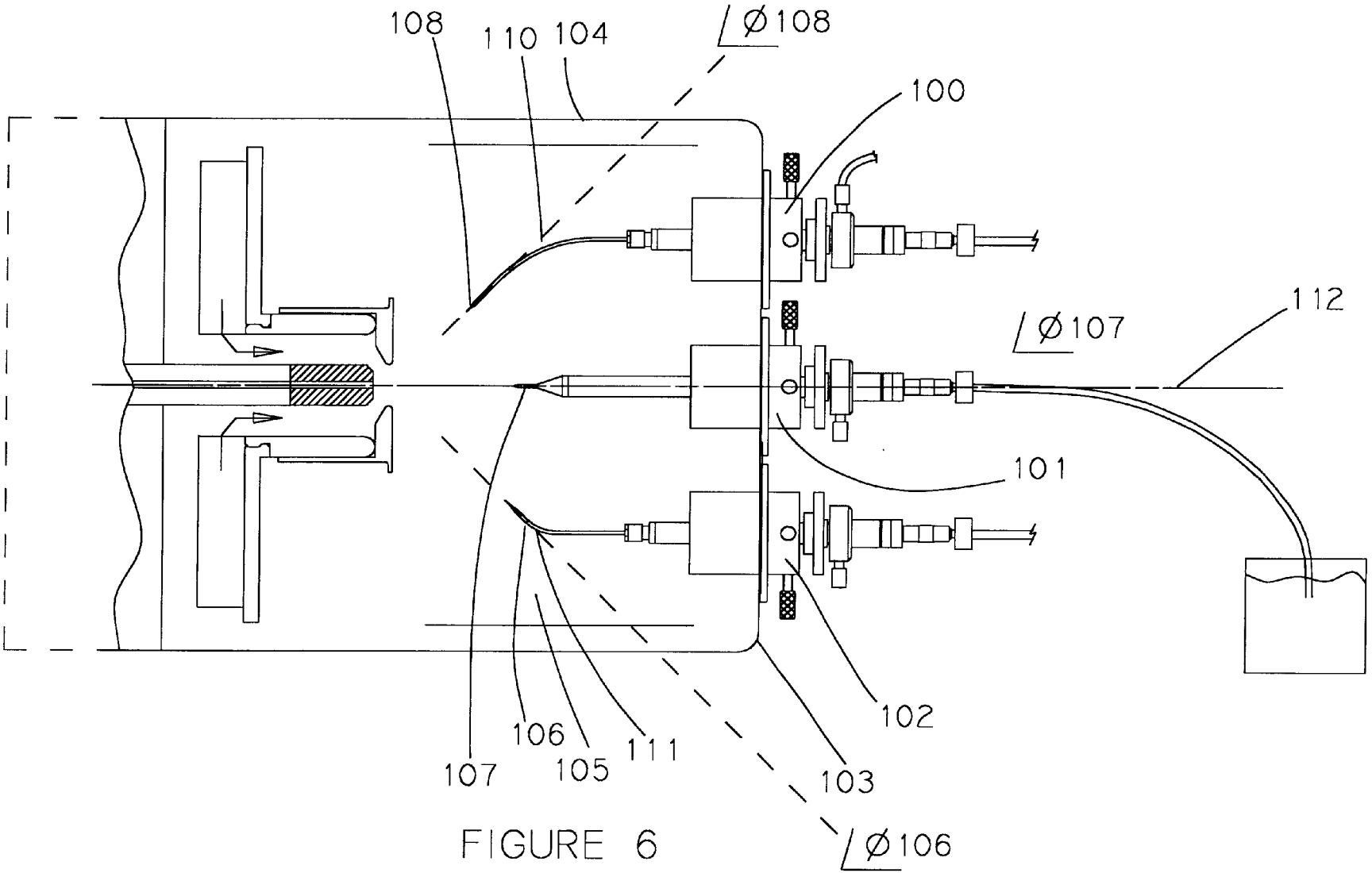
FIG. 6 is a diagram of an Electrospray ion source configured with two single bend Electrospray curved probes and a straight Electrospray probe.

ES probe assembly 13 is shown with a double bend in layered delivery tube assembly 29. The bends occur to the ES probe delivery tubes downstream of inlet ends 28, 30 and 33. In the embodiment shown, the first bend 31 is approximately 45 degrees and the second bend 32 is approximately 90 degrees resulting in an ES tip angle of approximately 45 degrees relative to the delivery tube entrance assembly 26 centerline 39. A range of bend angles 31 and 32 is possible with the ES probe configuration shown in FIG. 1 to achieve the desired tip angle and position. Alternatively, as is shown in FIG. 6, when the centerlines of ES probe assemblies 100 and 102 are mounted off ES source centerline 112, single bend curved ES probes can be configured. Bend angles in layered delivery tube assembly 29 have sufficiently large radii to avoid damaging individual tubes configured within layered tube assembly 29. The radii of bend angles 31 and 32 are large enough to prevent kinking or fracturing of tube materials such as metal or fused silica and allowing freedom of movement so that individual tubes remain free to slide through a layered tube configuration. The bend radii are sufficiently large to also allow rotation of layered tubes without damaging or forcing a permanent bend set to the tubing. Layered tube tip position adjustment may be configured with or without tube rotation. Generally no tube rotation is preferred, particularly when adjusting the first layer tube. When the first layer tube is a CE or LC column or a metal tube, the entrance end of the tube may be connected to a sample injection means external to probe assembly 13. The column or tube extends continuously from its rotationally fixed entrance end to ES probe tip 12 passing through and forming a seal with fitting 30 of ES probe 13. As will be described below, ES probe assembly 13 allows axial tip adjustment of the first layer tube without tube rotation.

It is obvious to one skilled in the art that any number of single or double bend geometric combinations can be configured:

1. Electrospray nebulizer tip angles ($\phi$) can range from $\phi$=020 to 180°
2. Electrospray nebulizer tip locations (R, r, $\theta$, z) can be set where R may equal any distance and r may equal any distance within the ES chamber, Angle $\theta$ can range from $\theta$=0° to 360° measured clockwise, and Z can equal any distance within the ES source chamber.
3. One, two or more bend angles, each with a range of angles and bend radii can be included in tubing assembly 29 to achieve a desired position and angle of ES probe tip 12.

Several Electrospray tip positions can be used to produce similar results. In addition, the Electrospray probe may include but is not limited to any combination of the following probe tip configurations: single tube unassisted Electrospray needle tip, flow through micro Electrospray, pneumatic nebulizer assist with or without liquid layer flow, ultrasonic nebulization assist thermal assist multiple tube layers.

Figure 2:
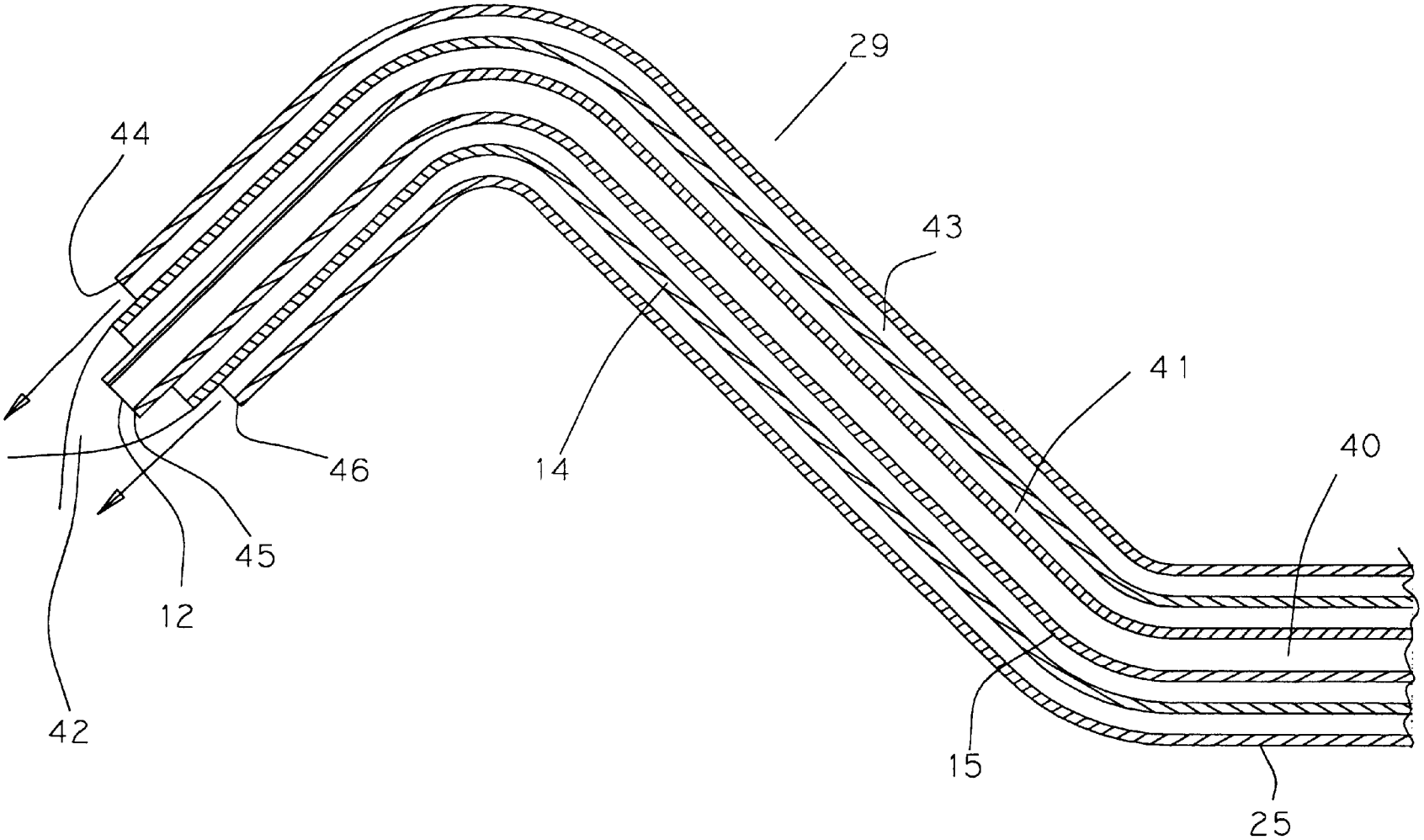
FIG. 2 is a cross-sectional view of a double bend curved three layer Electrospray probe tip.

FIG. 1 shows a three layer double bend curved ES probe configuration typically used when layered liquid flow is required during an Electrospray mass spectrometric analysis. A cross-section of one embodiment of double bend delivery tube 29 assembly and ES probe tip 12 with three tube layers is diagrammed in FIG. 2. Sample solution is delivered through curved ES probe delivery tube 15 to ES probe tip 12. A nebulization gas can be delivered to ES probe tip 12 through annulus 43 formed by the inner diameter of third layer tube 25 and the outer diameter of second layer delivery tube 14 to assist in the formation of charged liquid droplets during Electrospray operation. A second liquid flow can be delivered to ES tip 12 through annulus 41 formed by the inner bore of ES probe second layer delivery tube 14 and the outer bore of sample solution delivery tube 15. The second solution delivered to ES tip 12 through annulus 41 mixes in region 42 with the sample solution delivered to ES tip 12 through first layer delivery tube 15. ES probe assembly 13 as diagrammed in FIG. 1 is configured to allow adjustment of the relative layered tube exit tip positions from outside the ES source chamber during ES operation. The ability to adjust relative tube exit tip positions allows for the optimization of ES performance for any operating combination of single solution or multiple liquid flow layering with or without pneumatic nebulization assist. The curved ES probe configuration allows relative tube tip position adjustment to be made from outside the ES source chamber during ES operation independent of the ES tip angle or position in ES chamber 7. This ability to adjust layered tube exit tip positions to achieve optimal Electrospray performance is particularly important when the first layer tube is configured as a capillary electrophoresis fused silica column or as a capillary LC column. Such operation may require the layering of liquid flow through annulus 41 with solutions mixing in region 42 at ES probe tip 12.

The second layer solution flow may also be used to add a calibration compound to the sample bearing solution exiting from tube 15. The resulting mass spectrum acquired from such a mixed solution spray contains an internal standard. The calibration solution can be started or stopped by turning on or off the liquid flow from the liquid delivery system supplying solution through solution transfer line 28. The introduction of a calibration solution in this manner avoids contaminating the sample solution flowing through inner tube 15 but still necessitates mixing of solutions in region 42 prior to spraying. The calibration components in the resulting mixture may affect the Electrospray ionization efficiency of the sample compounds present thus causing peak height distortion in the acquired mass spectrum. The relative positioning of the exit ends of tubes 15 and 14 can affect the relative intensity of ion populations layered from the two solutions produced in the ES spraying and ionization process. The layered liquid flow can also be used to introduce a mixture of solvent solutions to study ion-neutral interactions in a multiple probe spray mixture. If required by an analytical application, any number of layers can be added to an ES layered probe tip assembly and the ES probe can be operated with multiple liquid and even gas layering. For example, a multi-layer probe can be operated such that there is no liquid mixing at the ES tip by separating the liquid solution layers with pneumatic nebulizer or corona suppression gas. A four layer ES probe tip embodiment can have liquid solution delivered through the innermost tube, nebulization gas flow supplied through the annulus between tubes one and two, a second liquid solution delivered through the annulus between tubes two and three, and nebulization gas flow supplied through the third annulus between tubes three and four. Alternatively, gas can be supplied through the innermost tube one with a liquid, gas and liquid layering. Three or more liquid solutions can be layered where some of the solutions delivered through separate layers are mixed in the liquid state as they emerge from the layered tip in a manner similar to that shown in FIG. 2. Where it is not desirable to mix selected solutions they may be separated by nebulizing gas layers. In general, layered liquid flow allows the introduction of additional solutions through one Electrospray probe, and can serve as a means of interfacing ES with separation systems such as CE, CEC and LC.

Three layer curved ES probe assembly 13 is configured to allow adjustment of the relative positions of exit ends 45, 44 and 46 of layered tubes 15, 14 and 25 respectively using adjustment means 36 and 38. Referring to FIGS. 1 and 3, adjustment knob 36 can be turned to move the position of delivery tube 15 and exit end 45 in or out while second and third layer tubes 14 and 25 remain fixed. Tube 15 slides inside tube 14 while adjusting the relative axial positions of tube exit ends 45 and 46. First layer tube exit end 46 position can be adjusted without turning tube 15 by holding knob 50 rotationally fixed while turning knob 36. This non rotational tip 45 position adjustment using knob 36 is convenient when tube 15 extends through fitting 30 and connects directly to a solution delivery system at its entrance end. This is typically the case when tube 15 is configured as a fused silica CE, CEC or capillary LC column connected directly to a CE, CEC or LC system respectively. Adjustment of the relative position of tube exit ends 44 and 45 is important when optimizing layered liquid flow performance used in CE-MS and LC-MS applications. The second layer tube 14 exit end 44 position can be adjusted relative to the position of tube 25 exit end 46 by turning ES probe body section 38 relative to section 37. Fitting 28 and transfer line 34 will rotate with ES probe section 38 when adjusting tube 14 exit end 44 position. The relative tube exit end positions 45 and 44 remain fixed when probe section 38 is turned. Transfer line 34 is connected to annulus 41 through fitting 28 to deliver a second liquid flow, nebulization gas or corona discharge suppression gas to ES tip mixing region 42 during operation. Gases such as oxygen or sulfur hexaflouride have been used to suppress corona discharge at the ES probe tip particularly for negative ion Electrospray operating mode. Adjusters 38 and 36 are located external to ES source chamber 7 to allow axial position adjustment of exit ends 45, 44 and 46 of layered tubes 15, 14 and 25, respectively, during Electrospray operation. The solution flow rate required for ES applications can range from below 25 nanoliters per minute to over 2 milliliters per minute. A first layer tube 15 with an inner bore diameter of approximately 100 micrometers can be configured in ES probe assembly 13 to accommodate Electrospraying a primary solution flow rate ranging from less than 1 $\mu$L/min to over 2 mL/min with one or more layered tubes. To optimize ES performance for a 25 to 1,000 nanoliter per minute liquid flow rate range, a smaller bore first layer tube can be installed in ES probe assembly 13 configured with one or more layered tubes of appropriately matched internal and external diameters. FIGS. 1 and 3 show a three layer ES probe configuration typically used when layered liquid flow is required during an Electrospray mass spectrometric analysis. Alternatively, ES probe assembly 13 can be configured with a single or two layer ES probe tip. Two layer probes are commonly employed when a single solution is introduced and Electrosprayed with pneumatic nebulization assist.

In the preferred embodiment, liquid or gas transfer lines 27, 28 and 18 all merge into a single (multi-layer) tube which extends through the ES probe assembly. Liquid or gas transfer line 18 is preferably attached to or coextensive with a first layer of the multilayer tube (e.g. the center layer of the tube). As the line proceeds toward the probe assembly 13, a second layer (i.e. a layer surrounding the center layer) is added by use of liquid or gas transfer line 28 which is attached to or coextensive with this second layer of the multilayer tube. As the line proceeds further toward probe assembly 13, a third layer (i.e. an outermost layer surrounding the center layer) is added and liquid or gas transfer line 27 is attached to or coextensive with this third layer of the multilayer tube. Each of the transfer lines therefore supplies liquid or gas to a separate layer of the multilayer delivery tube 29. The lines merge or are attached together in any desired manner, as will be apparent to one of ordinary skill in the art.

Figures 3A, 3B:
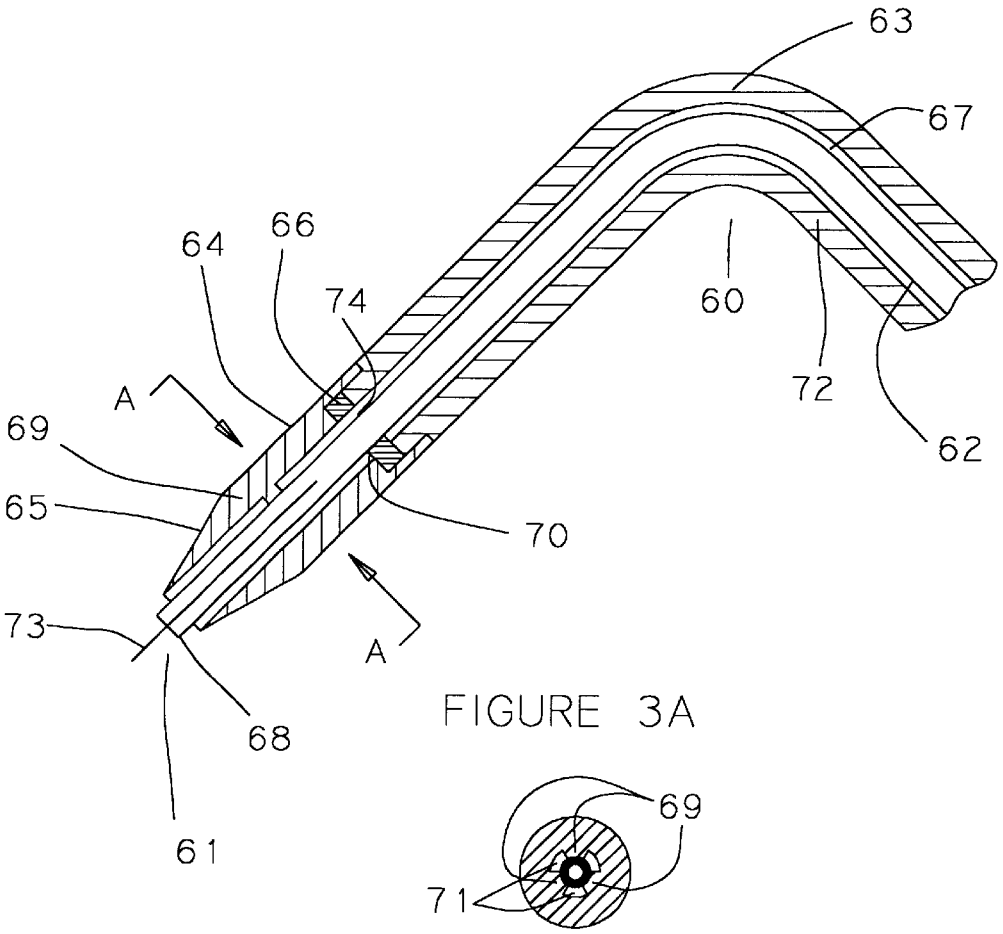
FIG. 3A is a cross-sectional view of a curved two layer ES tip with internal guides to hold the inner tube concentric with the outer tube at the ES tip exit.
FIG. 3B is cross-sectional view taken along A—A taken through the internal guide portion of the ES tip shown in FIG. 3A.

When a layered delivery tube assembly is configured with a single or a double bend, the layered tubes may no longer be positioned with their exit ends aligned concentric to a common ES probe tip centerline. The bend point nearest the ES tip may bias the outer diameter of each inner layered tube to fall against the wall of the inner bore of the next layer tube at its exit end. Although this may not adversely affect the overall Electrospray layered flow or pneumatic nebulization assist performance, the spray produced from the ES probe tip may not be axially symmetric with respect to the ES probe tip axis. The ES probe layered tube and tip position adjustment means described above allows the optimization of ES probe performance even with an asymmetric spray. The ES probe tip position adjustment allows placement of the optimal ion production region of the Electrospray plume in the capillary orifice sampling region. This can be achieved with the ES probe tip position adjustment for a wide range of analytical applications where solution chemistries, liquid flow rates and layered flow combinations may be varied. However, for some applications and ES source configurations it may be desirable to produce an axially symmetric spray from an Electrospray probe tip. An axially symmetric spray may be preferred when an ES probe with a fixed ES tip position is configured in an ES source chamber. Reduced ES probe assembly cost can be achieved by eliminating probe position adjusters. ES probe set up is simplified when no position adjustments are included. Holding tighter relative tube exit position tolerances and concentricity can improve the Electrospray plume symmetry around the ES probe tip centerline with and without pneumatic nebulization assist. This improved ES plume symmetry results in more consistent ES performance over a range of solution chemistries and solution flow rates and over multiple ES probe assemblies. FIGS. 3A and 3B show an alternative embodiment of the invention comprising a two layer curved S probe configured to improve the concentricity of layered tube exit ends at the ES probe tip.

FIG. 3A shows a cross section of the two layer curved ES probe delivery tube assembly 60 near ES probe tip 61. Inner solution delivery tube 62 is positioned within bore 67 of outer tube assembly 63 exiting at ES tip 61. Outer tube assembly 63 comprises separable tip piece 64, tapered tip portion 65 and guide piece 66. FIG. 3B is an axial view taken through section A—A showing the three finger position guide portion of separable tip piece 64. Guide piece 66 viewed along its axis is configured with a similar three finger guide shape. Inner tube 62 slides through tip piece 64 and guide piece 66 when assembled. Guide fingers 69 and 70 of tip piece 64 and guide piece 66 respectively position exit end 68 of inner tube 62 to align axially with axis 73 tip piece 64 at ES probe tip 61. Guide piece 66 is captured between a counterbore in tip piece 64 when it attaches to curved tube 63. Attachment means between tip piece 64 and cured tube 63 include but are not limited to press fitting, welding, brazing soldering or threading. Gaps 71 and 74 between fingers 69 and 70, respectively, allow the flow of nebulizing gas or layered liquid flow to ES tip 61. The position of exit end 68 of inner tube 62 may be adjusted relative to the exit end of tip piece 64 by sliding tube 62 through guide piece 66 and tip piece 64 using an adjustment means similar to that shown in FIG. 1. Alternatively, the position of exit end 68 of tube 62 may be fixed relative to tip piece 64 to minimize adjustments. Maintaining the axial position of inner tube 62 exit end 68 aligned along axis 73 will produce an Electrospray plume which is more symmetrically shaped around exit 73. This axial alignment insures multiple layer tube concentricity at the ES probe tip resulting in more consistent and optimized spray over many ES probe assemblies configured with or without position adjustment. Consistent ES spray operation improves reliability and reproducibility while simplifying Electrospray setup and operation and lowering apparatus cost.

Figure 4:
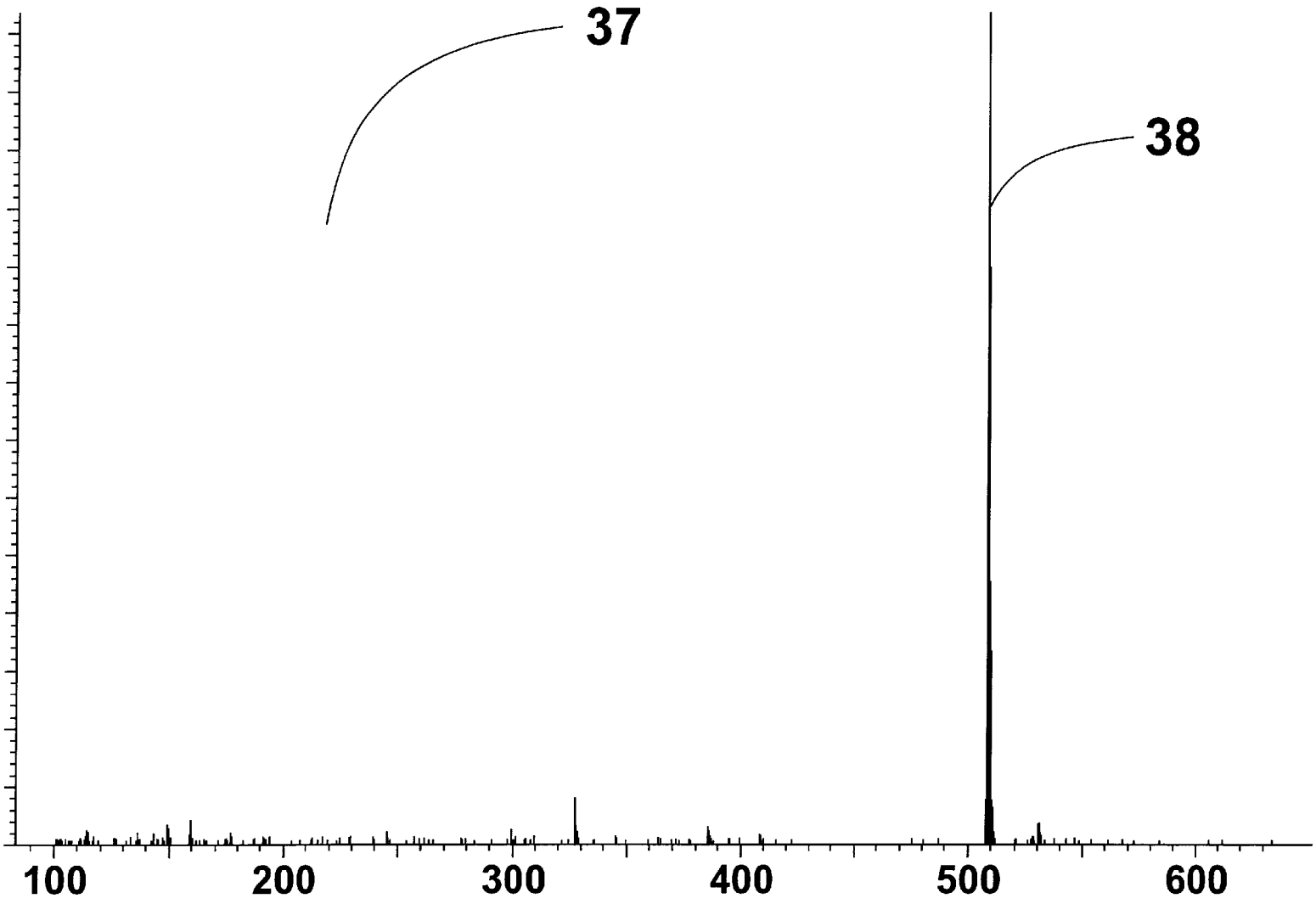
FIG. 4 is a mass spectrum of a sample solution containing Tri-Tyrosine introduced into an Electrospray ion source through a double bend Electrospray curved probe with pneumatic nebulization assist.

Mass spectrum 37 shown in FIG. 4 was acquired from a solution containing Tri-Tyrosine, Electrosprayed with pneumatic nebulization assist from a double bend two layer ES curved probe into an Electrospray ion source interfaced to a quadrupole mass spectrometer. The Electrospray probe tip was maintained at ground potential during the acquisition of mass spectrum 37 in FIG. 4. The Electrospray probe and source configuration used to acquire the data shown in FIG. 4 was similar to that diagrammed in FIG. 1. Peak 38 of protonated singly charged Tri-Tyrosine is the dominant peak in acquired mass spectrum 37. This spectrum was one acquired near the maximum signal amplitude of an eluting 20 μL injection of 5 pmole/μL Tri-Tyrosine solution injected into a solution of 50/50 methanol and water with 0.1% acetic acid supplied to the off-axis ES probe tip at a flow rate of 1 mL/min.

Figure 5:
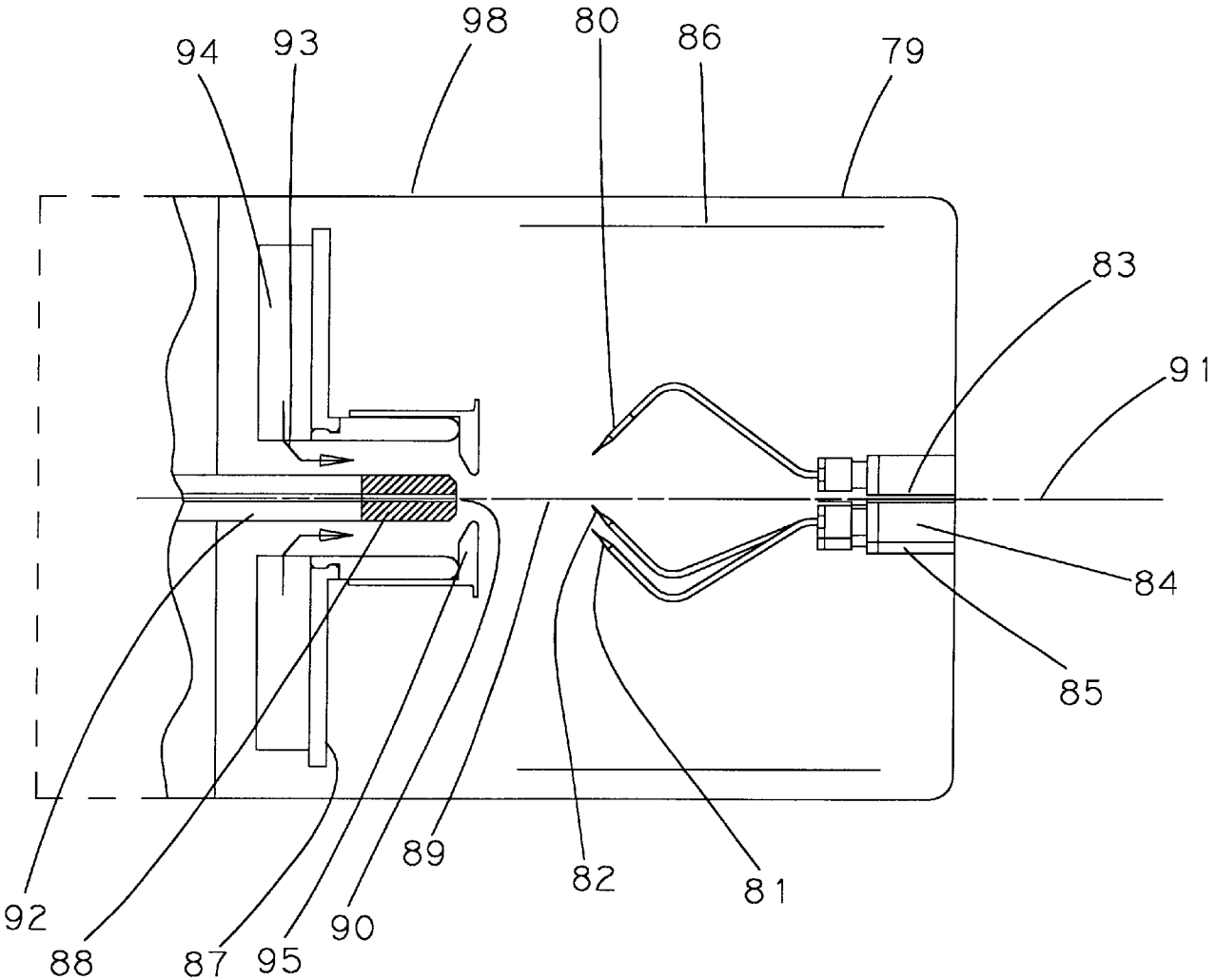
FIG. 5 is a diagram of an Electrospray ion source configured with three double bend Electrospray curved probes mounted with a relative tip off axis spacing of 120°.

Another embodiment of the invention, as diagrammed in FIG. 5, comprises an Electrospray ion source configured with multiple two bend curved Electrospray probes. The ES probes remain at the same potential during operation. With the appropriate potentials applied to lens elements in ES source chamber 79, Electrosprayed charged droplets are produced from separate solutions delivered to ES probe tips 80, 81, and 82 of ES probes 83, 84, and 85, respectively. Nebulization gas can be delivered to one or more ES probe tips 80, 81 and 82 through second layer tubes surrounding the sample introduction tubes to assist the Electrospray process in the formation of charged liquid droplets. Electrospray source 98 includes cylindrical electrode lens 86 dielectric capillary 92, counter current bath gas 93, gas heater 94, endplate electrode lens 87 and endplate nosepiece 95. Charged droplets Electrosprayed individually or simultaneously from solutions exiting from ES probe tip 80 of ES probe 83, tip 81 of ES probe 84 and tip 82 of ES probe 85 are driven against the counter-current drying gas by the electric fields formed by the electrical potentials applied to ES probe tips 80, 81 and 82 and/or ES chamber 79 electrodes 86, 87 and 88. As the charged droplets simultaneously produced from multiple ES probes evaporate, ions are formed and mixed in region 89 and a portion of these ions are swept into vacuum through the capillary orifice 90. A portion of the ions entering vacuum are directed into a mass analyzer and detector where they are mass analyzed. If a heated capillary is configured as an orifice into vacuum with or without counter-current drying gas, charged droplet evaporation and the production of ions can occur in the capillary when Electrosprayed charged droplets are swept into the capillary orifice. The resulting ions produced from a mixture of charged droplets, produced from two or three simultaneously Electrosprayed solutions, evaporating in the heated capillary will form an ion mixture in the capillary and in vacuum. Ions formed from multiple solutions can also form mixtures in ion traps in vacuum. Three dimensional ion traps and multipole ion guides operated in trapping mode can hold mixtures of ions trapped simultaneously or sequentially which are formed from multiple solutions sprayed into one API source. Mass analysis of the ion mixtures is then conducted. Different geometries of counter-current drying gas direction relative to the ES source axis and the axis of the orifice into vacuum such as "z spray" or "pepperpot" geometries can be configured with multiple curved ES probes, as well. ES probes 83, 84 and 85 are mounted on the rear plate of ES source chamber 79 each with independent x-y-z position adjusters. In the configuration shown, the x-y-z positions can be adjusted during system tuning to optimize each ES probe spray position when operating individual sprays or Electrospraying from multiple probes simultaneously. Each ES probe tip position can be adjusted to optimize performance for a wide range of liquid flow rates and solution composition combinations. ES probes 83, 84 and 85 may comprise one, two, three or more multi-layer probe tips.

Three different sample solutions can be Electrosprayed with similar or different liquid flow rates from ES probes 83, 84 and 85 independently and/or simultaneously during ES source operation. Charged droplets formed from the three sprays and the resulting ions produced from the three sets of evaporating charged droplets form a mixture of ions in region 89. A portion of the ion mixture produced is swept into vacuum through capillary orifice 90 where they are mass analyzed. Using this method, the sample solution from one ES probe has a minimum effect on the ions produced from the sample solution sprayed from a separate ES probe. The three sample solutions sprayed do not mix prior to spraying and droplets and ions of the same polarity are produced simultaneously in the Electrospray source. Charged droplets and ions of like polarity may have little interaction due to charge repulsion effects so a minimum distortion of the ion population produced occurs prior to entry into vacuum. If one solution sprayed contains one or more m/z calibration compounds, the ions produced form a true internal standard in the mass spectrum acquired from the mixture of ions that are produced from the two or three simultaneous sprays. The internal standard, however, is not mixed into the original sample solution during spraying. Alternatively, ES probe 83, 84 and 85 can be turned on sequentially. If one ES probe contains a calibration solution, sequential spraying of ES probes 83, 84 and 85 allows acquisition of a mass spectrum which can be used as an external standard acquired close in time to the acquisition of a second sample mass spectrum.

In the embodiment of the invention diagrammed in FIG. 5, the axes of ES probe assembly 83, 84, and 85 are positioned parallel to centerline 91 of ES source 98. The angle of each of ES probe tip 80, 81 and 82 relative to ES source centerline 91 is equal to $\phi_{80}$=45°, $\phi_{81}$=45°, and $\phi_{83}$=45°, respectively. Sample bearing solution can be introduced into the inlets of each probe with independent liquid delivery systems. In this manner, the flow of different samples or mixture of samples and/or solvents and can be controlled individually. Liquid delivery systems may include but are not limited to, liquid pumps with or without auto injectors, separation systems such as liquid chromatography or capillary electrophoresis, syringe pumps, pressure vessels, gravity feed vessels or solution reservoirs. During ES source operation, the spray produced from each ES probe can be initiated by turning on the liquid flow using a solution delivery system.

The x-y-z and angular positions of ES probe tips 80, 81 and 82 as configured in FIG. 5 may be adjusted to optimize ES performance individually or while spraying simultaneously, using a set of positioning knobs configured similar to those shown for ES probe 13 in FIG. 1. ES probe tip positions may require adjustment to optimize ES performance for a given liquid flow rate, solution chemistry and multiple spraying combinations. Once optimized, the probe positions can remain fixed during ES operation. The input ends of each ES probe, where solution and gas enter each ES probe assembly, and position adjusters are located outside the ES source chamber housing. This allows full adjustment of x-y-z and angular position while operating the ES source to achieve optimal performance. ES probes 83, 84 and 85 as diagrammed in FIG. 1 can also be configured to allow adjustment of the relative layered tube exit tip positions during ES operation. The solution flow rate required for ES applications can range from below 25 nanoliters per minute to over 2 milliliters per minute. Two or more Electrospray probes with pneumatic nebulization assist can be operated simultaneously in one ES chamber. Combinations of single tube, two layer, three layer, and multi-layer ES probes can also be configured and operated simultaneously in a single ES chamber.

ES source 79, as diagrammed in FIG. 5, is configured with three ES probes. ES probe tips 80, 81 and 82 are positioned at 45 degree angles to ES source centerline 91 ($\phi_{80}$=45°, $\phi_{82}$=45°, and $\phi_{83}$=45°) and each is respectively spaced a distance $Z_{80}$, $Z_{82}$ and $Z_{83}$ axially from end plate nosepiece 95. Each angle ES probe tip is spaced a radial distance $r_{81}$, $r_{82}$, and $r_{83}$ respectively, from ES source centerline 91 with a radial angle $\theta_{81}$=0°, $\theta_{82}$=120° and $\theta_{83}$=240° respectively, around ES source centerline 91. All curved ES probes can be operated with pneumatic nebulization assist, for the tip positions and angles given. Each ES probe is configured with a double bend tube assembly where the bend located closest to each ES probe body is approximately 45 degrees and the bend located closest to each ES probe tip is 90 degrees. The double bend tube portions of each ES probe allows a tight clustering of the body of multiple ES probe assemblies near ES source centerline 91. Configured with double bend curved ES probe assemblies, multiple ES probes can be configured into an ES chamber with small dimensions. In an analogous embodiment, but sacrificing some independence of probe tip location adjustment, multiple double bend tube portions can extend from a single ES probe body. Multiple transfer lines can connect into a single ES probe body supplying liquid or gas to multiple bent ES probe tips.

Another embodiment of the invention briefly mentioned above is diagrammed in FIG. 6. Three ES probes 100, 101 and 102 are mounted through back plate 103 of ES source 104. Each ES probe assembly individually includes multiple tube layers and full x-y-z position and angle adjustment of the probe tips in ES chamber 105. ES probes 100 and 102 are configured with single bend delivery tube portions 110 and 111, respectively, and are mounted off ES source centerline 112. Single bend portion 110 of ES probe 100 has a large radius of curvature which allows the layering of larger diameter tubes or fused silica columns without stressing the tubing material. Short liquid transfer distances can be accommodated with curved ES probes configured with a single bend. Similar to the double bend probes, the relative tube exit end positions of layered tubes can be axially adjusted even during ES source operation. Straight ES probe 101, mounted on ES source centerline 112, is configured with curved ES probes 100 and 102. Solution can be sprayed individually or simultaneously from the three ES probes configured in ES source 104. ES probe 100 tip 108 is positioned to spray at angle $\phi_{108}$ relative to the source centerline, ES probe 101 tip 107 is preferable positioned to spray approximately along ES source centerline 112 (although it can be configured to spray at an angle to the centerline, if desired) and ES probe 102 tip 106 is positioned to spray at angle $\phi_{106}$ relative to ES source centerline 112. The absolute value of angle $\phi_{108}$ may vary substantially from angle $\phi_{106}$ configured with fixed or adjustable position ES probe assemblies. Multiple "off-axis" and angled tip curved ES probes can be mounted in a small plate area reducing cost and complexity of API source design compared with a configuration using straight probe assemblies. Straight, single bend and/or double bend probes can be configured together in the same ES source, and for some extreme applications probes with more than two bends may be desired, depending on API source geometry. Ion-ion interaction can also be investigated in the same source by operating two or more bent probes at opposite polarities simultaneously. For example, a bent ES probe can be configured to produce positive ions with the source electrode potentials and mass spectrometer set to analyze positive ions. Another bent ES needle can be configured to spray at the first bent ES probe spray plume producing negative ions. The resulting mixture of opposite polarity ions reacting at atmosphere and the resulting positive product ions are then analyzed. The polarity of all ES source potentials can be switched to study negative product ions.

Figure 7:
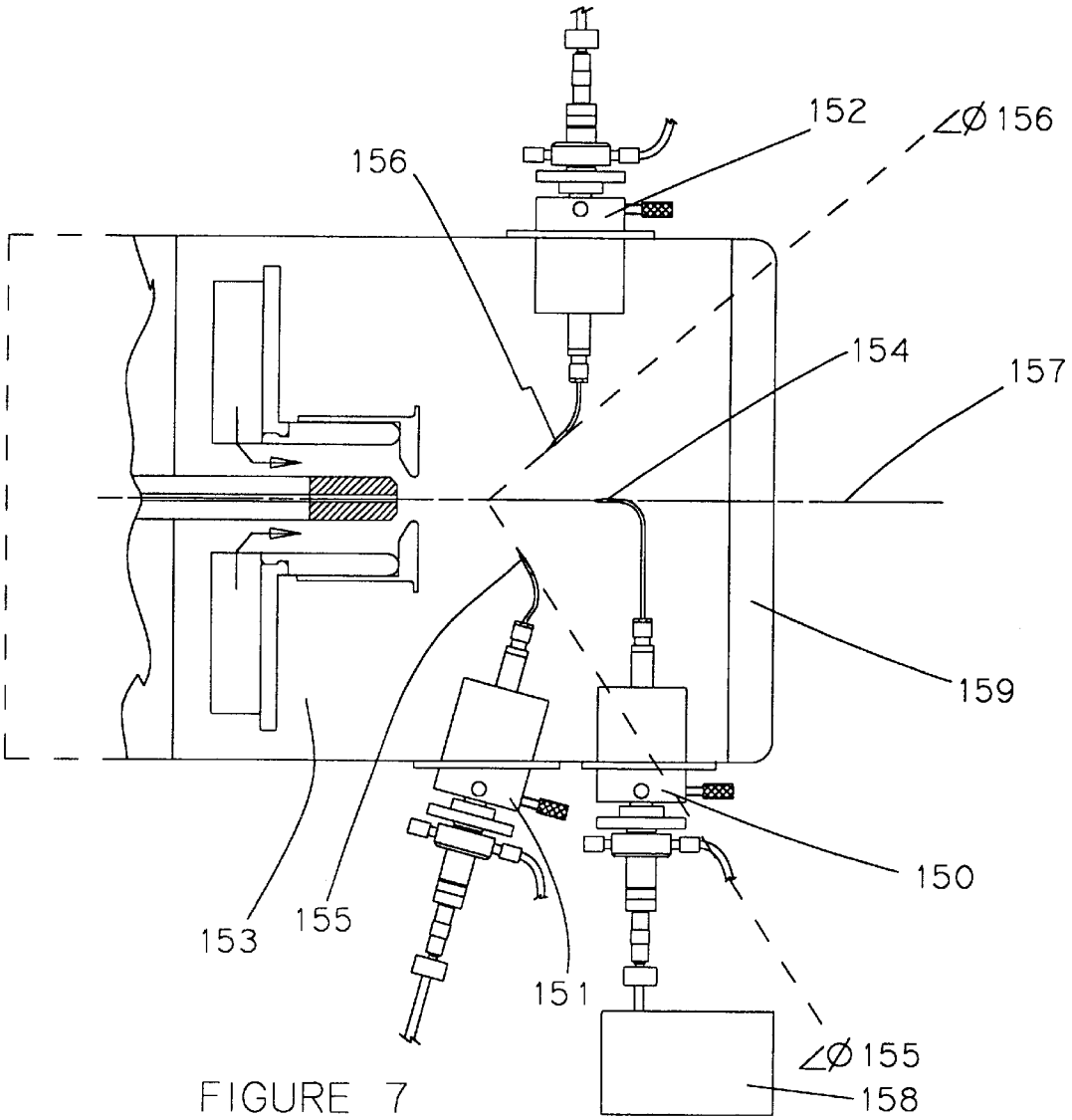
FIG. 7 is a diagram of an Electrospray ion source configured with three single bend Electrospray curved probes passing through the side walls with a glass window back plate.

Another embodiment of the invention is diagrammed in FIG. 7. In the configuration shown, three curved ES probe assemblies 150, 151, and 152 are mounted through the side walls of the ES chamber 153. ES probes tips 155 and 156 are configured to spray at angles $\phi_{155}$=60 degrees and $\phi_{156}$=−45 degrees, respectively, and are positioned off ES source centerline 157. ES probe tip 154 is configured to spray along ES source axis 157 while the axis of ES probe body 150 mounted −90 degrees to ES source centerline 157. This multiple ES probe mounting configuration is useful where it is not convenient to mount through the ES chamber back wall. Probes that must mount through the ES source back plate may constrain the ES source geometry and limit close placement of an LC or CE system next to the MS on the bench. Side wall mounting of multiple curve ES probes can allow the configuration of a small and shallow ES source geometry and may facilitate the integration of a CE or LC system 158 as a compact bench top system. In addition, a glass window back plate 159 can be configured in ES source 153 for viewing of the multiple Electrospray plumes in the ES source chamber 153. Similar to the previous embodiment, one or more adjustable or fixed position curved ES probes may be configured in ES source 153. Straight, single bend and/or double bend probes can be configured together in the same ES source mounted through the ES chamber side walls and endplate. For some extreme applications probes with more than two bends may be mounted through the ES source side wall, to accommodate a specific API source geometry.

Figure 8:
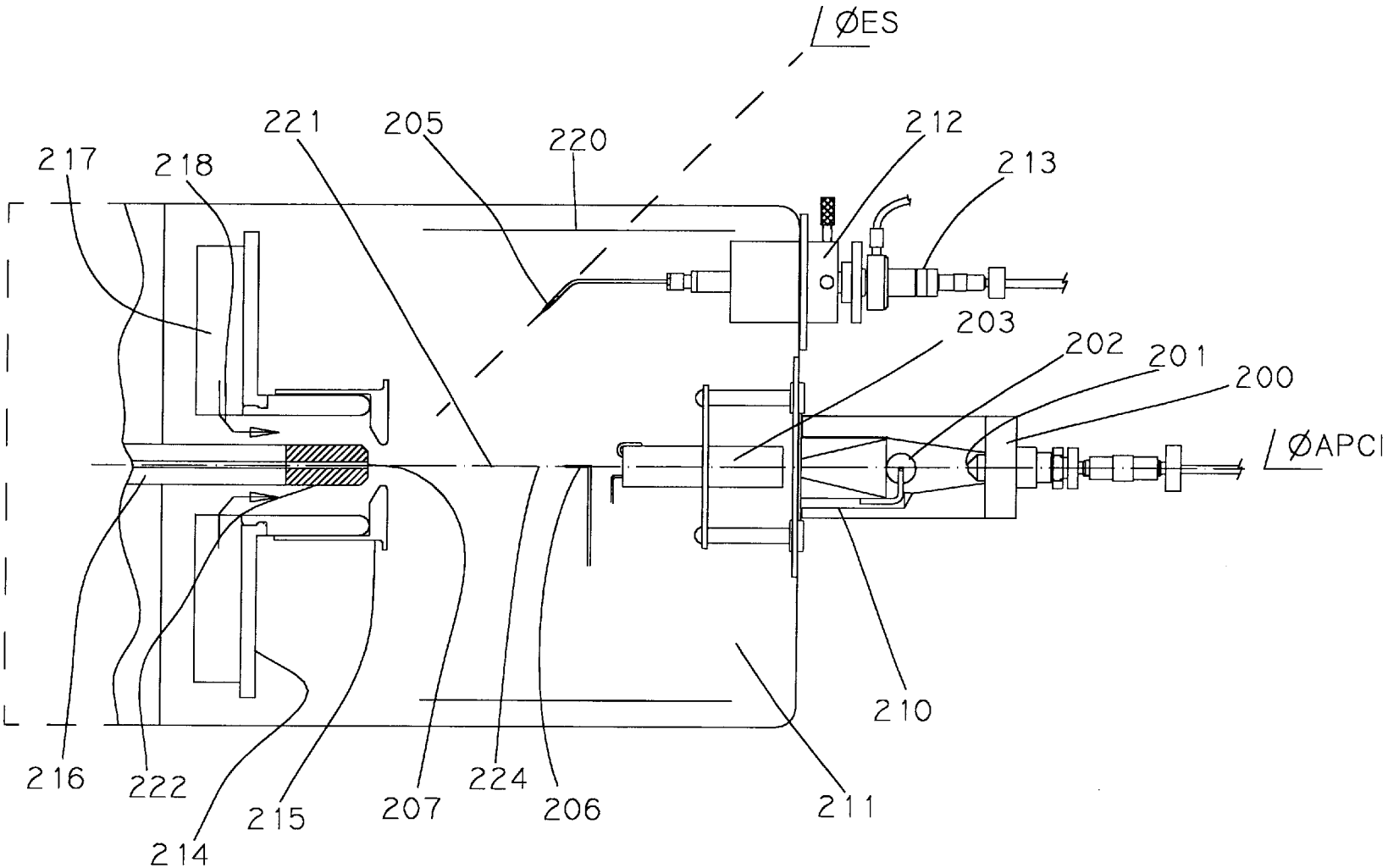
FIG. 8 is a diagram of an API source which includes an APCI probe and a single bend Electrospray curved probe.

It is obvious to one skilled in the art that any number of multiple curve and straight probe geometric combinations can be configured other than those specifically shown in FIGS. 7 and 8. Other combinations may include but are not limited to:

1. One, two, or more bent probes can be used with no, one, two, or more straight probes.
2. Electrospray nebulizer tip angles ($\phi_i$) can range from 0° to 180°,
3. Electrospray nebulizer tip locations ($R_i$, $r_i$, $\theta_i$, $z_i$) can be set where $R_i$ may equal any distance within the ES source chamber, $r_i$ may equal any distance within the ES source chamber, $\theta_i$=0° to 360° measured clockwise, and $z_i$ may equal any distance within the ES source chamber.
4. One, two or more bend angles each with a range of angles and bend radii can be included in any ES probe single or layered delivery tube assembly to achieve a desired position of any ES probe tip.
5. ES probe assemblies can be configured with fixed or adjustable ES probe tip locations.
6. Two or more Electrospray probes can be configured to spray the same or opposite polarity ions.

Several combination Electrospray tip positions can be used to produce similar results. In addition, multiple curved and straight Electrospray probes may include but are not limited to any combination of the following probe tip configurations: single tube Electrospray probe tips, flow through micro Electrospray, Electrospray with pneumatic nebulization assist with or without liquid layer flow, Electrospray with ultrasonic nebulizer assist, Electrospray with thermal assist and unassisted ES of multiple liquid layers.

Yet another embodiment of the invention is the combination of at least one curved Electrospray probe with at least one Atmospheric Pressure Chemical Ionization probe configured in an Atmospheric Pressure Ion Source interfaced to a mass analyzer. It is desirable for some analytical applications to incorporate both ES and APCI capability in one API source. Rapid switching from ES to APCI ionization methods without the need to reconfigure the API source minimizes the set up and optimization time. The same sample can be introduced sequentially or simultaneously through both APCI and the curved ES probes to obtain comparative or combination mass spectra. Acquiring both ES and APCI mass spectra of the same solution can provide a useful comparison to assess solution chemistry reactions or suppression effects with either ES or APCI ionization methods. Both ES and APCI probes can have fixed or moveable positions during operation of the API source. Alternatively, different samples can be introduced through the APCI and curved ES probes individually or simultaneously. For example, a calibration solution can be introduced through a curved ES probe while an unknown sample is introduced through an APCI probe in the same API source. The APCI and curved ES probes can be operated simultaneously or sequentially in this manner when acquiring mass spectra to create an internal or an external standard. The combination of APCI and curved ES probes configured together in an API source minimizes probe transfer and setup time and expands the range of analytical techniques which can be run with a manual or automated means when acquiring data with an API MS instrument. Combinations of sample introduction systems such as separation systems, pumps, manual injectors or auto injectors and/or sample solution reservoirs can be connected to the multiple combination ES and APCI probe API source. An integrated sample introduction with multiple APCI and ES probe combination allows fully automated analysis with multiple ionization techniques, multiple separation systems and one MS detector to achieve the more versatile and cost effective analytical tool with increased sample throughput. Each sample inlet can supply solution flows independently from other sample inlets either sequentially or simultaneously during APCI and ES operation. APCI probes can be configured where solvent is delivered to the APCI probe at flow rates below 500 nL/min to above 2 mL/min.

FIG. 8 is a diagram of an embodiment of the invention which includes ES and APCI ionization capability configured together in an API source interfaced to a mass analyzer. APCI probe and ionization assembly 210 and curved Electrospray probe assembly 212 are configured in API source 211. APCI probe and ionization assembly 210 is comprised of inlet probe assembly 200 with nebulizer tip 201, optional droplet separator ball 202, vaporizer heater 203 and corona discharge needle 206. The APCI inlet probe assembly 200 is configured to spray at an angle of $Ø_{APCI}$ (with $Ø_{APCI}$=0° in the figure) along API source centerline 221. Curved Electrospray probe assembly 212 is configured within the figure a two layer ES probe tip with first layer tube exit end position external adjustment nut 213 (although any configuration of one or more curved Electrospray assemblies can be used, as disclosed above). Curved Electrospray probe assembly 212 is configured to spray at an angle of $Ø_{ES}$ (with $Ø_{ES}$=45 degrees in the figure) relative to the source centerline 221. The API source assembly includes cylindrical lens 220, endplate 214 with attached nosepiece 215, capillary 216, counter-current drying gas flow 218 and gas heater 217. Curved ES probe tip 205 is positioned a distance ZES axially from nosepiece 215 and radially rES from API source centerline 221. Electrical potentials applied to cylindrical lens 220, endplate 214 with nosepiece 215, capillary entrance electrode 222, bent ES tip 205 and APCI corona needle 206 can be optimized to operate both the bent ES and APCI probes simultaneously. Counter-current drying gas flow 218, the nebulization gas flow from ES probe tip 205 and the nebulizer and makeup gas flow through APCI vaporizer 203 are balanced to optimize performance of simultaneous ES and APCI operation. Alternatively, the curved ES and APCI probes can be operated sequentially with fixed positions by turning on and off the solution and/or nebulizing gas flow for each probe sequentially. One or more Electrospray mass spectra can be acquired with solution flow and voltage applied to the curved ES probe 212 turned on while solution flow to APCI inlet probe 200 and voltage applied to corona discharge needle 206 are turned off. Liquid flow and voltage applied to curved ES probe 212 can then be turned off and liquid flow to APCI inlet probe 200 and the voltage applied to corona discharge needle 206 can be turned on prior to acquiring one or more APCI mass spectra.

Different solutions or the same solutions can be delivered through the APCI and curved ES probes during acquisition of mass spectra. The electrical potentials applied to elements in the API source may be adjusted for ES and APCI operation to optimize performance for each solution composition and liquid flow rate. Also, positions of elements in the API source may be moved and then repositioned depending on whether the curved ES or APCI probe is operating. For example, if APCI probe 210 is operating and no sample is being delivered through curved ES probe 212, the voltage applied to bent ES probe tip 205 can be set so that tip 205 will appear electrically neutral so as not interfere with the electric field in corona discharge region 224. Similarly, when curved ES probe 212 is operating and sample flow to APCI probe 210 is turned off, voltage can be applied to corona discharge needle 206 so that it either does not interfere with the Electrospray process or it improves the Electrospray performance. For example, voltage applied to corona discharge needle 206 can aid in driving Electrospray produced ions into capillary orifice 207. Alternatively, the position of APCI corona discharge needle 206 can be moved temporarily during curved ES probe 212 operation to minimize interference with the Electrospray ionization process. APCI corona discharge needle 206 can then be moved back into position during APCI probe operation. Opposite polarity ES and APCI operation can be configured to produce one polarity of ions from APCI corona discharge region 224. For example, negative polarity charged liquid droplets can be produced by spraying the Electrospray plume generated from curved ES probe tip 205 at corona discharge region 224 which is operated in positive ion production mode. The resulting mixture of opposite polarity ions reacting at atmospheric pressure in corona discharge region 224 can then be analyzed by the mass spectrometer operating in positive ion mode. Several combinations of sample inlet delivery systems, as have been described earlier, can be interfaced to the combination ES and APCI API source. Multiple curved ES and multiple APCI inlet probes can be configured in an API source assembly. The APCI and curved ES probe assemblies can be configured to mount through the API source chamber walls or within the API chamber. Several combinations of multiple ES probe tips can be configured by one skilled in the art and the invention is not limited to those APCI and curved ES probe embodiments specifically described herein.

The following references are referred to in this application, the disclosures of which are hereby fully incorporated herein by reference: U.S. Pat. No. 5,495,108, issued Feb. 27, 1996 to Apffel, James; Werlich, Mark; and Bertach, James; U.S. Pat. No. 4,542,293 issued Sep. 17, 1985 to Fenn, John B., Yamashita, Masamichi, and Whitehouse, Craig M.; and PCT application entitled "Multiple Sample Introduction Mass Spectrometry", filed Sep. 11, 1997, in the names of Analytica of Branford, Inc., Bruce Andrien Jr., Michael A Sansone, and Craig M. Whitehouse.

Having described the invention with respect to particular embodiments, it is to be understood that the description is not meant as a limitation since further modifications and variations may be apparent or may suggest themselves. It is intended that the present application cover all such modifications and variations.

We claim:

1. An apparatus for producing ions from solution comprising:

a. an Electrospray ion source with at least one Electrospray sample introduction probe;

b. said Electrospray probe comprising a curved portion;

c. said curved portion comprising at least one fluid channel.

2. An apparatus according to claim 1, wherein said curved probe has at least two curved concentric layers.

3. An apparatus according to claim 1, wherein said curved probe has at least three curved concentric layer.

4. An apparatus according to claim 1, wherein said curved probe comprises an exit tip, and wherein the position of said exit tip is adjustable in said ion source.

5. An apparatus according to claim 1, wherein said Electrospray probe comprises a tip comprising an axis, and each of said at least one fluid channels comprises an exit end, and wherein the relative position of said exit end of each of said fluid channels is adjustable along said axis of said Electrospray probe tip.

6. An apparatus according to claim 1, wherein at least one of said fluid channels comprises a narrow bore.

7. An apparatus according to claim 1, wherein said curved probe comprises at least two layered fluid channels, and further comprises means to adjust the relative position of said layered fluid channels.

8. An apparatus according to claim 7, wherein each of said layered fluid channels comprises an exit end, and wherein the relative position of said exit end of each of said layered fluid channels is adjustable along a common centerline.

9. An apparatus according to claim 1, wherein said curved portion comprises one bend.

10. An apparatus according to claim 1, wherein said curved portion comprises at least two bends.

11. An apparatus according to claim 1, wherein said ion source comprises at least two said curved Electrospray probes.

12. An apparatus according to claim 1, wherein said ion source comprises two of said Electrospray probes, and wherein said two curved Electrospray probes can be operated simultaneously.

13. An apparatus according to claim 12, wherein said apparatus is configured such that ions produced from said at least two simultaneous Electrospray probes mix.

14. An apparatus according to claim 1, wherein said ion source is interfaced to a mass spectrometer.

15. An apparatus according to claim 14, wherein said ions are mass to charge analyzed in said mass spectrometer.

16. An apparatus according to claim 1, wherein said ion source is configured with means for delivering said ions into vacuum.

17. An apparatus for producing ions from solutions comprising:

a. an ion source operated substantially at atmospheric pressure which produces ions from solutions;

b. at least one curved Electrospray probe through which at least one solution is introduced into said ion source; and c. at least one Atmospheric Pressure Chemical Ionization probe through which at least one solution is introduced into said ion source.

18. An apparatus according to claim 17, wherein at least one of said probes comprises flow through a microtip.

19. An apparatus according to claim 17, wherein said means for producing ions comprises both an Electrospray and an Atmospheric Pressure Chemical Ionization means.

20. An apparatus according to claim 17, wherein said means for mixing said ions produced, mixes said ions substantially at atmospheric pressure.

21. A method for producing ions from solution comprising the steps of:

providing solution to an Electrospray ion source comprising at least one Electrospray sample introduction probe, said Electrospray probe comprising a curved portion, said curved portion comprising at least one fluid channel.

22. A method according to claim 21, wherein said curved probe has at least two curved concentric layers.

23. A method according to claim 21, wherein said curved probe has at least three curved concentric layer.

24. A method according to claim 23, wherein the exit end of said curved probe comprises means to position said layered fluid channels in a substantially concentric position along a common said Electrospray probe tip centerline.

25. A method according to claim 24, wherein the relative position of the exit end of each of said layered fluid channels is adjustable along said common centerline.

26. A method according to claim 21, wherein said curved probe exit tip position is adjustable in said ion source.

27. A method according to claim 21, wherein the relative position of the exit end of each of said fluid channels is adjustable along the axis of said Electrospray probe tip.

28. A method according to claim 21, wherein said means for producing ions comprises a counter electrode.

29. A method according to claim 21, wherein said means for producing ions comprises an Electrospray with nebulization assist means.

30. A method according to claim 21, wherein at least one of said curved Electrospray probes comprises flow through narrow bore or microtip said fluid channel.

31. A method according to claim 21, wherein said means for producing ions comprises both an Electrospray and an Atmospheric Pressure Chemical Ionization means.

32. A method according to claim 21, wherein said curved portion comprises one bend.

33. A method according to claim 21, wherein said curved portion comprises at least two bends.

34. A method according to claim 21, wherein said ion source comprises at least two said curved Electrospray probes.

35. A method according to claim 34, wherein said at least two said curved Electrospray probes can be operated simultaneously.

36. A method according to claim 35, wherein ions produced from said at least two simultaneous Electrosprays mix in the atmospheric pressure ion source.

37. A method according to claim 21, wherein said ion source is interfaced to a mass spectrometer.

38. A method according to claim 37, wherein said ions are mass to charge analyzed in said mass spectrometer.

39. A method according to claim 21, wherein said ion source is configured with means for delivering said ions into vacuum.

40. A method for producing ions from solutions comprising:

operating an apparatus comprising an ion source, wherein said apparatus comprises at least one curved Electrospray probe, and wherein said apparatus further comprises at least one Atmospheric Pressure Chemical Ionization probe.

41. A method according to claim 40, wherein solutions are introduced through said curved Electrospray probe and said Atmospheric Pressure Chemical Ionization probe individually.

42. A method according to claim 40, wherein solutions are introduced through said curved Electrospray probe and said Atmospheric Pressure Chemical Ionization probe simultaneously.

43. A method according to claim 40, wherein at least one of said probes comprises flow through a microtip.

44. An apparatus for producing ions from solution comprising:

an Electrospray ion source comprising at least one Electrospray sample introduction probe, said Electrospray probe comprising a curved portion, said curved portion comprising at least one fluid channel.

45. An apparatus according to claim 44, wherein said curved probe has at least two curved concentric layers.

46. An apparatus according to claim 44, wherein said curved probe has at least three curved concentric layers.

47. An apparatus according to claim 44, wherein said curved probe comprises an exit tip, and wherein the position of said exit tip is adjustable in said ion source.

48. An apparatus according to claim 44, wherein said Electrospray probe comprises a tip having an axis; wherein and each of said fluid channels comprises an exit end; and wherein the relative position of said exit end of each of said fluid channels is adjustable along said axis of said Electrospray probe tip.

49. An apparatus according to claim 44, wherein at least one of said curved Electrospray probes comprises flow through a narrow bore.

50. An apparatus according to claim 44, wherein said curved probe comprises layered fluid channels and an exit end, and wherein said exit end comprises means to adjust the relative positions of said layered fluid channels with respect to each other.

51. An apparatus according to claim 50, wherein the relative position of the exit end of each of said layered fluid channels is adjustable along a common centerline.

52. An apparatus according to claim 44, wherein said curved portion comprises one bend.

53. An apparatus according to claim 44, wherein said curved portion comprises at least two bends.

54. An apparatus according to claim 44, wherein said ion source comprises at least two of said curved Electrospray probes.

55. An apparatus according to claim 54, wherein both of said two curved Electrospray probes can be operated simultaneously.

56. An apparatus according to claim 55, wherein the ions produced from simultaneous operation of said Electrospray probes mix inside said apparatus.

57. An apparatus according to claim 44, wherein said ion source is interfaced to a mass spectrometer.

58. An apparatus according to claim 57, wherein said ions are mass to charge analyzed in said mass spectrometer.

59. An apparatus according to claim 44, wherein said ion source is configured with means for delivering said ions into vacuum.

* * * * *